United States Patent [19]

Dugenet et al.

[11] Patent Number: 4,775,382

[45] Date of Patent: Oct. 4, 1988

[54] PROCESS FOR BLEACHING HOUSEHOLD LAUNDRY IN A WASH CYCLE

[75] Inventors: Yann Dugenet, Issy-les-Moulineaux; Gisele Landan, Asnieres-sur-Seine, both of France

[73] Assignee: Atochem, France

[21] Appl. No.: 873,418

[22] Filed: Jun. 12, 1986

[30] Foreign Application Priority Data

Jun. 21, 1985 [FR] France ..... 85 10121

[51] Int. Cl.[4] ..... D06L 3/02; D06L 3/04

[52] U.S. Cl. ..... 8/111; 8/101; 8/137; 252/95; 252/99; 252/186.28; 134/26

[58] Field of Search ..... 252/95, 99, 102, 186.28; 8/101, 111, 137; 134/29, 26

[56] References Cited

U.S. PATENT DOCUMENTS 3,525,695 8/1970 Mouret et al. ..... 252/95
4,283,302 8/1981 Foret et al. ..... 252/95

FOREIGN PATENT DOCUMENTS 538580 3/1980 Australia .
3697980 8/1984 Australia .
2104942 9/1970 France .

*Primary Examiner*—Paul Lieberman
*Assistant Examiner*—John F. McNally
*Attorney, Agent, or Firm*—Sigalos, Levine & Montgomery

[57] ABSTRACT

A process for bleaching household laundry in a wash cycle, comprising a first stage in said cycle in which the laundry is washed in the presence of a detergent composition free of any peroxide-type bleaching agent at a temperature between about 40° to 60° C. and a pH between about 8 and 12, rinsing said laundry, and subjecting said laundry to a second stage in said cycle in which said rinsed laundry is washed in the absence of any detergent and in the presence of at least one peroxide-type bleaching agent and an activator at a temperature between about 40° to 60° C. and a pH between about 9 and 13.

9 Claims, No Drawings

PROCESS FOR BLEACHING HOUSEHOLD LAUNDRY IN A WASH CYCLE

BACKGROUND OF THE INVENTION

The present invention pertains to the bleaching of household laundry in a two-stage wash cycle.

Formulations for washing household laundry essentially are currently available, which are described as "complete" and which contain both agents with detergent action and agents with bleaching action. The most common of the former agents are the surface-active agents, sodium polyphosphates and especially sodium tripolyphosphate. The per salts, and especially sodium perborate, are most common among the agents of the second type.

These per salts or peroxyhydrates are relatively expensive carriers of active oxygen, and any improvement of their bleaching effect that can be manifested is an undeniable economic gain.

Such an improvement is to be sought especially at a low temperature, 70° C. or less.

In fact, the per salts are no longer effective enough under these conditions, and it is necessary to add so-called activating compounds to them, whose expense partially reduces the gain attributable to the reduction of the thermal energy consumption.

The activators can be chemical compounds of diverse nature. However, such compounds as, e.g., tetraacetylethylenediamine (TAED),α-acetoxy-α-methyl-N,N'-diacetylmalonamide, which is the subject of French Patents published as Nos. 2,363,541 and 2,363,629, cyanamide and its derivatives, which are the subject of a French Patent published as No. 2,340,371, are most widely used industrially and are most commonly mentioned.

SUMMARY OF THE INVENTION

The process according to the present invention permits the bleaching effect of the peroxide-type bleaching agents such as the per salts, but also hydrogen peroxide, to be improved if they are used at a temperature of at most 70° C. in the presence of an activator in the course of a household laundry wash cycle.

Briefly, the present invention comprises a process for bleaching household laundry in a wash cycle, comprising a first stage in said cycle in which the laundry is washed in the presence of a detergent composition free of any peroxide-type bleaching agent at a temperature between about 40° to 60° C. and a pH between about 8 and 12, rinsing said laundry, and subjecting said laundry to a second stage in said cycle in which said rinsed laundry is washed in the absence of any detergent ahd in the presence of at least one peroxide-type bleaching agent and an activator at a temperature between about 40° to 60° C. and a pH between about 9 and 13.

DETAILED DESCRIPTION

The bath of the first stage contains, in nature and in quantity, the detergent products usually present in a conventional prewash, which is currently carried out with a conventional detergent composition which starts a known wash cycle, such as, e.g., sodium tripolyphosphate, in its usual amount.

It may also contain the ingredients usually present in such detergent compositions, such as the conventionally used metal ion-complexing agents, surface-active agents, bluing and the like, in their usual amounts.

The bleaching agents present in the bath of the second stage are selected from among those commonly used in the complete detergent compositions to ensure their bleaching function for bleachable stains in household laundry; e.g., hydrogen peroxide, the per salts or peroxyhydrates, such as sodium perborate, sodium percarbonate and urea peroxyhydrate.

The active oxygen concentration resulting from the presence of such peroxide-type bleaching agents is generally between 0.004 and 0.03 wt. % relative to the weight of the bath.

The activator accompanying the bleaching agent in the bath of the second stage may be of various natures without jeopardizing, however, the improvement caused by the present invention. However, improved bleaching effect is especially observed if the activator is of the TAED or cyanamide type, such as calcium cyanamide.

The molar ratio of the peroxide-type bleaching agent to the activator may vary within rather broad limits especially depending on the nature of either of the compounds. It is often between 1 and 10. For example, if hydrogen peroxide or sodium perborate is selected as the bleaching agent and the activator is of cyanamide or TAED type, it will more generally be between 5 and 10.

If necessary, it is possible to use at least one conventional proteolytic enzyme in the course of the first stage.

The majority of the detergent compositions comprises compounds of a sufficiently alkalizing character for the pH value in the first stage to be reached simply because of their presence during the said stage. However, it is also possible to add an additional alkaline agent, e.g., sodium hydroxide, to them.

The pH value is reached during the second stage by means of a usual alkaline agent which is not oxidized or is reduced by the peroxide-type bleaching agents; sodium hydroxide is most frequently selected essentially for economic reasons and convenience.

Even though a substantial improvement of the bleaching effect is observed if the pH value is higher than 12.5 during the second stage, the risk of degradation of the cellulose fibers will no longer be negligible. The preferred pH range in the second stage is between about 9.5 and 12.5.

The temperature range of about 40° C.–60° C. is indicated for carrying out the present invention, because at temperatures below 40° C., it only leads to an insignificant improvement of the bleaching effect, and the energy consumption soon becomes prohibitive above 60° C. in comparison with the additional improvement of the bleaching effect then obtained.

The overall duration of the first and second stages is generally shorter than one hour, and neither phase usually exceeds 0.5 hour.

The process according to the present invention will be further described by the following examples which are set forth for purposes of illustration only.

In these examples:

(i) The term "detergent" means the standardized EMPA detergent in powdered form based on sodium tripolyphosphate (ca. 43.8 wt. %).

(ii) The two stages of the process are carried out in an AHIBA G VI B water bath agitated vertically and by rotation.

(iii) The weight ratio of the bath to the material to be bleached is ca. 20 in each stage of the process according to the presence as well as in the single stage of the so-called "complete" washing processes which are described for comparison. The relatively high value of this ratio is solely due to the type of device used.

(iv) The material to be bleached included standardized EMPA fabrics with wine stains, tea stains, or protein soil (milk, blood, India ink, and the like). The protein soil stained fabrics are designated as "p.s."

(v) The two stages are carried out at the same temperature, selected to be 40° C. or 60° C., the selected temperature being reached after a temperature rise for 20 minutes in the first case and after a temperature rise lasting 30 minutes in the second from an ambient temperature of ca. 20° C.

(vi) The bath used in the first stage, whose pH value is 9.6, contains 5.8 g detergent per liter.

(vii) The bath used in the second stage, whose pH value, reached by adding sodium hydroxide, will be indicated further below on a case-by-case basis, contains (per liter):

(a) 0.09 g active oxygen, supplied either in the form of a 35 wt. % aqueous solution of hydrogen peroxide or in the form of sodium perborate, (b) calcium cyanamide or TAED, taken in such a quantity that the molar ratio of hydrogen peroxide or sodium perborate to the activator equals 8.5, and (c) as the case may be, 0.0232 g of a proteolytic enzyme, ESPERASE, from the firm of NOVO.

(viii) The washings described for comparison are so-called "complete" washings. They comprise a single stage, which is carried out at the temperature and pH value indicated on a case-by-case basis, the duration of the process being 60 minutes, beyond which time there is practically no further improvement in the bleaching effect in the presence of the detergent, bleaching agent, activator and, as the case may be, enzyme and other ingredients, taken in quantities equaling the combined quantities present in each of the two stages in the embodiment of the present invention, with which they are directly comparable, and only the quantity of sodium hydroxide can be adjusted as needed so that the pH value during the "complete" washing may be the same as during the second stage of the process according to the present invention (ix) As was indicated, the treated laundry is rinsed in the conventional manner after each stage of the process according to the present invention as well as after the single "complete" wash stage.

(x) The bleaching effect is determined from the difference between the whiteness indices before and after the application of the wash cycle or as a variation of whiteness in percentage of a maximum white of 100, according to the formula:

$$\text{bleaching effect} = \frac{\text{variation of white}}{100 - \text{initial whiteness}} \times 100.$$

The measurements are carried out with an ELREPHO spectrophotometer equipped with a No. 8 filter from the firm of CARL ZEISS.

EXAMPLES 1 TO 8

Examples 1 through 8 concern the experiments carried out with calcium cyanamide used as the activator.

Examples 1 through 5 were carried out according to the present invention, and Examples 6 through 8 were carried out for comparison according to the conditions specified above for the "complete" washing, with the understanding that the first stage in Example 5 and the single stage in Example 8 were carried out in the presence of ESPERASE.

Table I below synoptically shows the results obtained as a function of the temperature and the pH value of the bath in the second stage of the process according to the present invention or the "complete" wash bath.

TABLE I

| Example No. | Temperature °C. | pH | Bleaching effect Wine | Tea | P.S. |
|---|---|---|---|---|---|
| 1 | 60 | 9 | 52 | 26.5 | |
| 2 | 60 | 11 | 60 | 39 | |
| 3 | 60 | 12.5 | 61.5 | 41 | |
| 4 | 40 | 11 | 49 | 27.5 | |
| 5 | 60 | 11 | 61 | 40.5 | 46.5 |
| 6 | 60 | 11 | 51.5 | 24 | |
| 7 | 60 | 12.5 | 56.5 | 30 | |
| 8 | 60 | 11 | 49 | 32.5 | 36.5 |

EXAMPLES 9 TO 13

Examples 9 through 13 concern the experiments carried out with TAED used as the activator.

Examples 9 through 11 were carried out according to the present invention, and Examples 12 and 13, given for comparison, were carried out under the conditions specified above for "complete" washing.

The results are reviewed in Table II below as a function of the temperature and the pH value of the bath of the second stage of the process according to the present invention and the bath of the "complete" washing process.

TABLE II

| Example No. | Temperature °C. | pH | Bleaching effect Wine | Tea |
|---|---|---|---|---|
| 9 | 60 | 9 | 58 | 32.5 |
| 10 | 60 | 9.5 | 59 | 38 |
| 11 | 60 | 13 | 58.5 | 41 |
| 12 | 60 | 9.5 | 49.5 | 32 |
| 13 | 60 | 12.5 | 58.5 | 33 |

Certain comparisons in Tables I and II demonstrate the advantages of the process according to the present invention.

In particular, it is apparent from the comparison of the Experiments 6 and 2, Experiments 7 and 3, Experiments 12 and 10, and Experiments 8 and 5 that at a given temperature and a given pH value, the process according to the present invention leads to a substantial increase in the bleaching effect. The effect has increased here by a factor of ca. 1.2 in the case of wine, by a factor of 1.2 up to 1.6 in the case of tea, and by a factor of 1.3 in the case of the protein stains.

The comparison of Experiments 6 and 1 as well as Experiments 13 and 9 clearly shows that at a given temperature, the present invention permits a given bleaching effect to be achieved at a pH value lower by 2 units than that necessary in the prior-art process.

Besides the fact that all other conditions remain similar, the process according to the present invention generally reduces the overall duration of the operation, the comparison of Experiments 6 and 4 shows that a result obtained at 60° C. according to the prior-art process can practically be achieved at 40° C. by operating according to the present invention.

Very similarly, albeit generally slightly poorer results are obtained if the above-described experiments are repeated by replacing the hydrogen peroxide by sodium perborate.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A process for bleaching household laundry in a wash cycle, comprising a first stage in said cycle in which the laundry is washed in the presence of a detergent composition free of any peroxide-type bleaching agent at a temperature between about 40° to 60° C. and a pH between about 8 and 12, rinsing said laundry, and subjecting said laundry to a second stage in said cycle in which said rinsed laundry is washed in the absence of any detergent and in the presence of at least one peroxide-type bleaching agent and an activator at a temperature between about 40° to 60° C. and a pH between about 9 and 13.

2. The process of claim 1, wherein the second stage is carried out at a pH between about 9.5 and 12.5

3. The process of either claim 1 or 2, wherein the detergent composition is based on sodium tripolyphosphate.

4. The process of claim 1 or 2, wherein the second stage is carried out in the presence of at least one peroxide-type bleaching agent selected from hydrogen peroxide, sodium perborate, sodium percarbonate, or urea peroxyhydrate.

5. The process of claim 1 or 2, wherein the quantity of peroxide-type bleaching agent is equivalent to an active oxygen concentration between about 0.004 and 0.03 wt. % in the seoond stage.

6. The process of claim 1 or 2, wherein the molar ratio of the peroxide-type bleaching agent to the activator is between 1 and 10.

7. The process of claim 1 or 2, wherein the activator is selected from calcium cyanamide or tetraacetylethylenediamine. ethylenediamine.

8. A process for bleaching household laundry in a wash cycle comprising a first stage in said cycle in which the laundry is washed in the presence of a sodium tripolyphosphate-based detergent composition free of any peroxide-type bleaching agent at a temperature between about 40° to 60° C. and a pH between about 8 and 12, rinsing said laundry, and subjecting said laundry to a second stage in said cycle in which said laundry is washed in the absence of any detergent and in the presence of at least one peroxide-type bleaching agent selected from hydrogen peroxide, sodium perborate, sodium percarbonate, or urea peroxyhydrate and an activator selected from calcium cyanamide or tetraacetylethelyenediamine at a temperature of from about 40° C. to 60° C. and a pH between about 9.5 to 12.5; the molar ratio of peroxide-type bleaching agent to activator being between about 5 to 10 and the quantity of said bleaching agent being equivalent to an active oxygen concentration between about 0.0004 and 0.03 wt. % in said second stage.

9. The process of claim 1 or 8, wherein a proteolytic enzyme is included in said first stage wash.

* * * * *

UNITED STATES PATENT AND TRADEMARK OFFICE

CERTIFICATE OF CORRECTION

PATENT NO. : 4,775,382

DATED : October 4, 1988

INVENTOR(S) : Dugenet et al.

It is certified that error appears in the above-identified patent and that said Letters Patent are hereby corrected as shown below:

Column 5, line 27, after "13" -- , a bleaching agent being used in said wash cycle only in said second stage --;

Column 6, line 12, after the first "." cancel "ethylenediamine"; and

Column 6, line 31, "0.0004" should read -- 0.004 --.

Signed and Sealed this

Twenty-first Day of February, 1989

*Attest:*

*Attesting Officer*

DONALD J. QUIGG

*Commissioner of Patents and Trademarks*